US009279423B2

(12) United States Patent
Yamazaki et al.

(10) Patent No.: US 9,279,423 B2
(45) Date of Patent: Mar. 8, 2016

(54) SCROLL TYPE FLUID MACHINE WITH NOTCHES ON A MOTOR HOUSING

(71) Applicant: Hitachi Industrial Equipment Systems Co., Ltd., Chiyoda-ku, Tokyo (JP)

(72) Inventors: Shumpei Yamazaki, Tokyo (JP); Yoshiyuki Kanemoto, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 14/339,954

(22) Filed: Jul. 24, 2014

(65) Prior Publication Data

US 2015/0093275 A1 Apr. 2, 2015

(30) Foreign Application Priority Data

Sep. 30, 2013 (JP) ..... 2013-202987

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 2/02*** | (2006.01) |
| ***F04C 2/07*** | (2006.01) |
| ***F04C 18/07*** | (2006.01) |
| ***F01C 17/06*** | (2006.01) |
| ***F01C 21/10*** | (2006.01) |
| ***F04C 29/00*** | (2006.01) |
| ***F04C 18/02*** | (2006.01) |
| *F04C 23/00* | (2006.01) |

(52) U.S. Cl.

CPC ..... *F04C 2/025* (2013.01); *F01C 17/066* (2013.01); *F01C 21/10* (2013.01); *F04C 2/07* (2013.01); *F04C 18/0215* (2013.01); *F04C 18/07* (2013.01); *F04C 29/005* (2013.01); *F04C 29/0071* (2013.01); *F04C 23/008* (2013.01); *F04C 2240/30* (2013.01)

(58) Field of Classification Search

CPC .... F04C 18/0215; F04C 18/07; F04C 23/008; F04C 2/07; F04C 2/025; F04C 29/005; F04C 29/0071; F04C 2240/30; F16D 3/04; F01C 17/066; F01C 21/10

USPC ..... 418/55.1–55.6, 57, 60; 464/102

See application file for complete search history.

(56) References Cited

U.S. PATENT DOCUMENTS 7,044,722 B2 * 5/2006 Fujioka et al. ..... 418/55.3
7,377,759 B2 * 5/2008 Ishizuki ..... 418/55.3

(Continued)

FOREIGN PATENT DOCUMENTS

JP 06213174 A * 8/1994 ..... F04C 18/02
JP 2001123969 A * 5/2001 ..... F04C 18/02

(Continued)

OTHER PUBLICATIONS

Korean Office Action issued in counterpart Korean Application No. 2014-0071959 dated Sep. 16, 2015 (four (4) pages).

*Primary Examiner* — Theresa Trieu

(74) *Attorney, Agent, or Firm* — Crowell & Moring LLP

(57) ABSTRACT

A plurality of notches or holes is formed on a motor housing or compressor casing. This permits assembling of the auxiliary crankshaft to the auxiliary crank bearing even after the motor housing and the compressor casing are fastened together. Hence, the assembly can be performed in sequential steps.

9 Claims, 3 Drawing Sheets

(56) References Cited

U.S. PATENT DOCUMENTS

| | | | | |
|---|---|---|---|---|
| 2009/0246058 | A1* | 10/2009 | Komai et al. | 418/55.3 |
| 2010/0221134 | A1* | 9/2010 | Kanaizumi et al. | 418/55.3 |

FOREIGN PATENT DOCUMENTS

| | | | | | |
|---|---|---|---|---|---|
| JP | 2006-274972 | A | | 10/2006 | |
| JP | 2009-257337 | A | | 11/2009 | |
| JP | 2011252448 | A | * | 12/2011 | F04C 18/02 |

* cited by examiner

SCROLL TYPE FLUID MACHINE WITH NOTCHES ON A MOTOR HOUSING

BACKGROUND OF THE INVENTION

1. Field of the Invention

The present invention relates to a scroll type fluid machine.

2. Description of the Related Art

A conventional scroll compressor integrating a compressor and a motor is known from Japanese Patent Application Laid-Open No. 2009-257337 (Patent Document 1). The Patent Document 1 discloses a structure which includes a compressor body including a fixed scroll and an orbiting scroll, and a motor section for rotatably driving the orbiting scroll and in which a motor output shaft is connected to a driving shaft of the orbiting scroll via a shaft coupling and a cooling fan.

In the scroll compressor of the Patent Document 1 which integrates the compressor and the motor, the motor output shaft and the driving shaft of the orbiting scroll are separated. Therefore, in an assembly process for the scroll compressor integrating the compressor and the motor, the compressor body and the motor section are discretely assembled and then, are fastened together using the shaft coupling and the like. On the other hand, in a case where the motor output shaft is directly used as the driving shaft of the orbiting scroll, the method in which the compressor body and the motor section are discretely assembled and then are fastened together, as disclosed in the Patent Document 1, involves a problem of increased assembly costs because the assembly process is divided. Further, the compressor body must be disassembled from the motor section to overhaul the compressor body or to replace components of the compressor body. This results in lowered maintenability.

In the scroll compressor, the orbiting scroll is provided with an auxiliary crank for preventing the autorotation thereof. To fasten the auxiliary crank to a bearing of a compressor casing, the auxiliary crank need be fastened to the compressor casing by handling a tool from a motor fastening side. Therefore, the fastening between the auxiliary crankshaft and a holding bearing cannot be made after the motor section is fastened to the compressor body. This necessitates the steps of: separating the compressor body from the motor section; fastening the auxiliary crank, as a component of the compressor body, to the compressor casing; and then fastening the compressor body and the motor section together. This results in the problems of increased assembly costs and lowered maintenability as mentioned above.

In this connection, the present invention seeks to provide a compressor-motor integrated scroll compressor that takes assembly costs and maintenability into consideration.

SUMMARY OF THE INVENTION

According to the invention for achieving the above object, a plurality of notches or holes are formed on a motor housing or the compressor casing.

The invention permits the auxiliary crankshaft to be mounted to an auxiliary crank bearing even in a state where the motor housing and the compressor casing are fastened together. Hence, the motor section and the compressor portion can be assembled in sequential steps. This results in the reduction of assembly costs.

DESCRIPTION OF THE PREFERRED EMBODIMENTS

Preferred embodiments of the invention will be described as below with reference to the accompanying drawings.

First Embodiment

Figure 1:
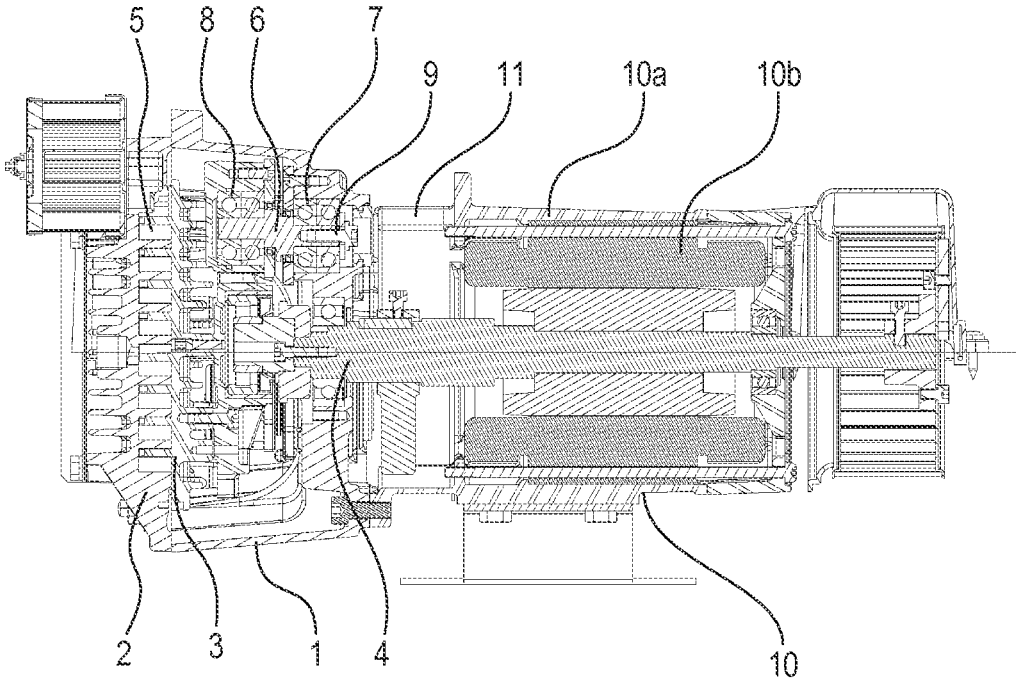
FIG. 1 is a diagram showing an overall structure of a compressor-motor integrated scroll compressor according to a first embodiment of the invention.

FIG. 1 is a diagram showing an overall structure of a compressor-motor integrated scroll compressor according to a first embodiment of the invention. In FIG. 1, a motor is indicated at 10; a motor housing for accommodating the motor is indicated at 10*a*; a compressor casing for accommodating a compressor is indicated at 1; a fixed scroll disposed in the compressor casing and formed with an upright involute wrap is indicated at 2; and an orbiting scroll driven via a driving shaft 4 defined by a rotary shaft of the motor, placed in opposed relation with the fixed scroll and formed with an upright involute wrap defining a plurality of compression chambers between itself and the wrap of the fixed scroll is indicated at 3.

The orbiting scroll 3 is driven by the driving shaft 4 to perform an orbiting motion via an orbiting bearing so as to accomplish compression by contracting the compression chambers 5 formed between the orbiting scroll and the fixed scroll as orbiting toward the center. In this case, the orbiting scroll 3 has an auxiliary crankshaft 6 for prevention of the autorotation thereof. The auxiliary crankshaft 6 is retained by a compressor-casing side auxiliary crank bearing 7 mounted to the compressor casing 1 and an orbiting-scroll side auxiliary crank bearing 8 mounted to the orbiting scroll 3.

The auxiliary crankshaft 6 and the orbiting-scroll side auxiliary crank bearing 8 are fixed to the orbiting scroll 3 and are fastened to the compressor-casing side auxiliary crank bearing 7 with a fastening member 9. The compressor-casing side auxiliary crank bearing 7 is mounted to the compressor casing 1 from a side opposite from the orbiting scroll 3.

Notches 11 are disposed on the motor housing 10*a* of the motor 10 and at places between a stator 10*b* in the motor and the compressor-casing side auxiliary crank bearing 7 so as to permit work of fastening the auxiliary crankshaft 6 to the compressor-casing side auxiliary crank bearing 7 with the motor 10 fastened to the compressor casing 1.

Figure 2:
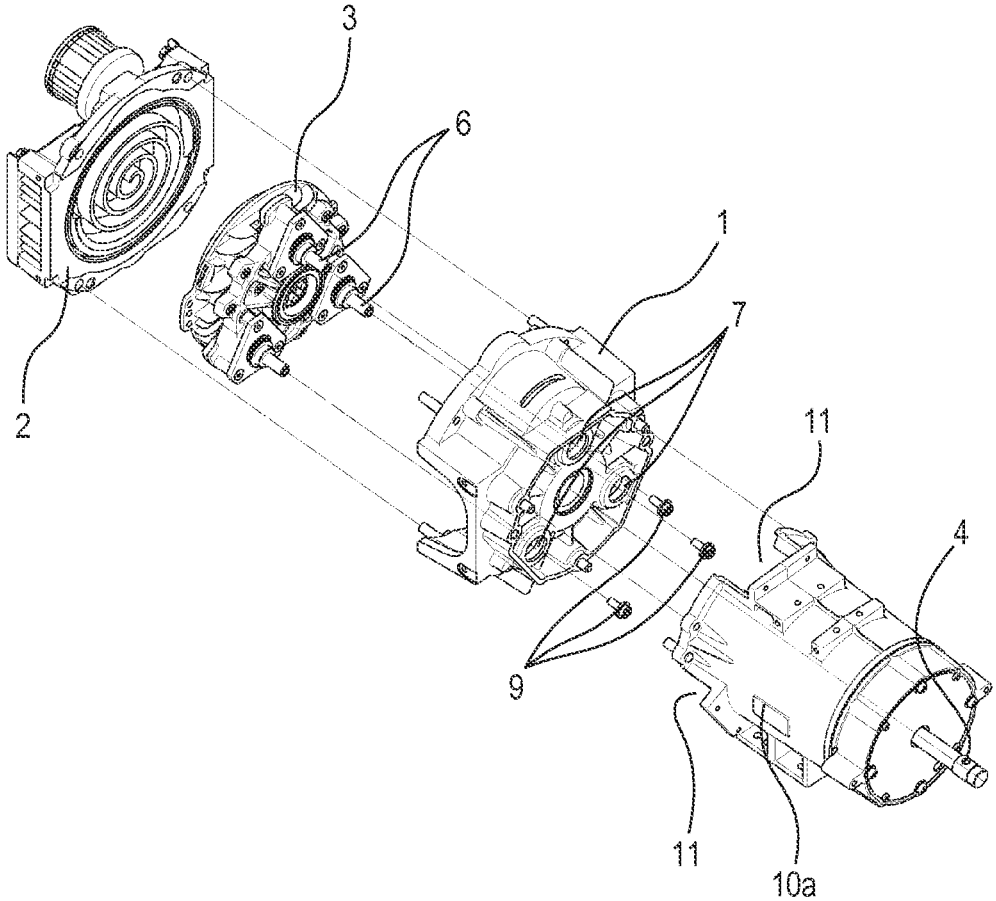
FIG. 2 is an exploded schematic of the first embodiment.

FIG. 2 is an exploded schematic of the related components of the first embodiment. Referring to FIG. 2, the motor housing 10*a* constituting the motor 10 and the compressor casing 1 are fastened together in a first step of an assembly procedure. Subsequently, the orbiting scroll 3 with the auxiliary crankshaft 6 fixed thereto via the orbiting-scroll side auxiliary crank bearing 8 is fastened to the compressor casing 1. In this process, a tool is inserted through the notch 11 to handle the fastening member 9 so as to fasten a motor-side end of the auxiliary crankshaft 6 to the compressor-casing side auxiliary crank bearing 7 mounted to the compressor casing 1. Subsequently, the fixed scroll 2 is fastened to the compressor casing 1 to complete the assembling of the compressor-motor integrated scroll compressor.

This embodiment includes three auxiliary crankshafts 6 and three notches 11 corresponding to the auxiliary crankshafts respectively. The compressor-casing side auxiliary crank bearings 7 are arranged on the same circle at intervals of 120° such that the load is distributed evenly. Further, the notches 11 are also arranged on the same circle at intervals of 120° in corresponding relation with the auxiliary crank bearings 7. Therefore, the tool can be inserted through each one of the notches 11 to fasten each one of the auxiliary crankshafts 6 to each corresponding compressor-casing side auxiliary crank bearing 7.

The notches 11 may be located at any position to allow the tool to be inserted therethrough to access the compressor-casing side auxiliary crank bearings 7. For example, two notches may be formed for three compressor-casing side auxiliary crank bearings 7. In such a case, the driving shaft 4 and its associated components exist centrally of one notch 11 and hence, the other notch 11 may be disposed on the opposite of the driving shaft from the one notch so as to circumvent the driving shaft. Namely, the notches are arranged in a manner that the adjoining notches form an angle of less than 180° therebetween as seen from the driving shaft. It is desirable to decide a circumferential width and an axial length of the notch in consideration of the workability of work with the tool.

The number of the auxiliary crankshafts 6 need be more than one because the provision of a single auxiliary crankshaft involves fear that the load is concentrated on one point to induce deformation. For example, there may be provided two auxiliary crankshafts or four auxiliary crankshafts. However, it is desirable to provide three auxiliary crankshafts as the required minimum number for even load distribution. In the case of plural auxiliary crankshafts, it is also necessary to provide a plurality of notches because the driving shaft and its associated components exist at the center, making it difficult to fasten the plural auxiliary crankshafts through the single notch.

As described above, the embodiment provides for a sequential assembly process where the end product is assembled by sequentially assembling the components in the construction order of the product. The assembly process can be integrated into one assembly line so that, for example, the components can be sequentially mounted on top of each other with good work efficiency. Hence, the increase in assembly costs can be suppressed. When the compressor body is overhauled or component replacement is performed, the auxiliary crankshaft 6 can be disassembled from the compressor-casing side auxiliary crank bearing 7 through the notch 11 without disassembling the compressor body from the motor section. Hence, the embodiment has an effect in improving maintenability.

As a solution to the problem that fastening between the auxiliary crankshaft and its holding bearing cannot be made after the motor section and the compressor body are fastened together, it may be contemplated to dispose a fastening part between the auxiliary crankshaft and the holding bearing on an outer side relative to the motor housing. In such a case, however, the product is increased in the outside diameter, resulting in increased product dimension. In this respect, the embodiment can solve the above problem of increased product dimension by providing the notches 11.

Second Embodiment

Figure 3:
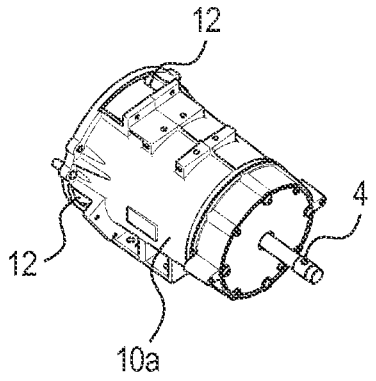
FIG. 3 is a diagram showing an example of a motor housing of a second embodiment of the invention which is formed with holes.

A second embodiment is described with reference to FIG. 3.

The second embodiment pertains to the same compressor-motor integrated scroll compressor as that of the first embodiment except that the aforementioned notches are replaced with holes having a hole structure. As shown in FIG. 3, the motor housing 10*a* is formed with holes 12.

Similarly to the first embodiment, this embodiment permits the product assembly process to be performed in sequential steps or to be integrated into one assembly line. Thus, the increase in assembly costs can be suppressed. When the compressor body is overhauled or component replacement is performed, the auxiliary crankshaft 6 can be disassembled from the compressor-casing side auxiliary crank bearing 7 through the notch 11 without disassembling the compressor body from the motor section. Hence, the embodiment has an effect in improving maintenability. Further, the motor housing 10*a* is increased in strength at its end, which is effective in suppressing deformation of the motor housing being worked.

Instead of providing the notches 11 or holes 12, an independent member formed with holes may be attached to the motor housing 10*a* such that the overhauling or component replacement is performed through the holes.

Third Embodiment

Figure 4:
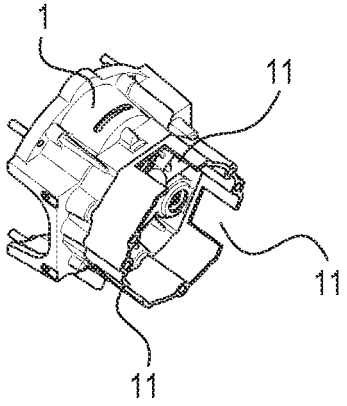
FIG. 4 is a diagram showing an example of a compressor casing of a third embodiment of the invention which is formed with notches.

A third embodiment is described with reference to FIG. 4.

The third embodiment pertains to the same compressor-motor integrated scroll compressor as that of the first embodiment except that the aforementioned notches 11 are formed in the compressor casing 1. Referring to FIG. 4, the compressor casing 1 is formed with notches 11 extended toward a fastening part with the motor while the motor housing 10*a* is not formed with the notches.

Similarly to the first embodiment, this embodiment permits the product assembly process to be performed in sequential steps or to be integrated into one assembly line. Thus, the increase in assembly costs can be suppressed. When the compressor body is overhauled or component replacement is performed, the auxiliary crankshaft 6 can be disassembled from the compressor-casing side auxiliary crank bearing 7 through the notch 11 without disassembling the compressor body from the motor section. Hence, the embodiment has an effect in improving maintenability. Further, the motor housing 10*a* is simplified in structure, which is effective in reducing production costs.

Fourth Embodiment

Figure 5:
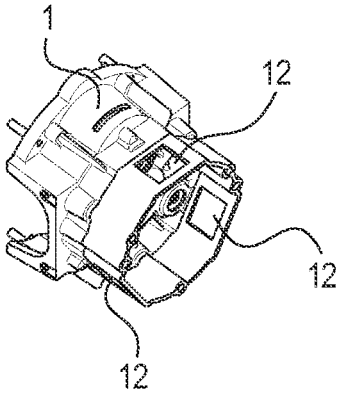
FIG. 5 is a diagram showing an example of a compressor casing of a fourth embodiment of the invention which is formed with holes.

A fourth embodiment is described with reference to FIG. 5.

The fourth embodiment pertains to the same compressor-motor integrated scroll compressor as that of the third embodiment except that the aforementioned notches are replaced with holes having a hole structure. Referring to FIG. 5, the compressor casing 1 is formed with holes 12 extended toward the fastening part with the motor while the motor housing 10*a* is not formed with the notches or holes.

Similarly to the third embodiment, this embodiment permits the product assembly process to be performed in sequential steps or to be integrated into one assembly line. Thus, the increase in assembly costs can be suppressed. When the compressor body is overhauled or component replacement is performed, the auxiliary crankshaft 6 can be disassembled from the compressor-casing side auxiliary crank bearing 7 through the notch 11 without disassembling the compressor body from the motor section. Hence, the embodiment has an effect in improving maintenability. Further, the motor housing 10*a* is increased in strength at its end, which is effective in suppressing deformation of the motor housing being worked. As described above, the first to fourth embodiments have the structures where the motor housing 10*a* or the compressor casing 1 is formed with the notches 11 or the holes 12. However, an alternative structure may be made such that the notches 11 or the holes 12 are capped. This structure is adapted for internal protection of the compressor and the motor 10 and for reduction of noises from the compressor and the motor 10.

According to the first to fourth embodiments, the motor housing 10*a* or the compressor casing 1 is formed with the notches 11 or the holes 12. Alternatively, an independent member formed with holes may be disposed between the motor housing 10*a* and the compressor casing 1. Otherwise, the part between the motor housing 10*a* and the compressor casing 1 may be formed with the notches 11 or the holes 12 through which overhaul of the compressor body or component replacement is performed.

While the embodiments of the invention have been described, it is to be noted that the invention is not limited to the aforementioned embodiments but includes various modifications. Further, a part of the structure of one embodiment can be replaced with a structure of another embodiment. Further, a structure of another embodiment can be added to a structure of one embodiment. Apart of the structure of each embodiment also permits addition of another structure, omission or replacement.

What is claimed is:

1. A scroll type fluid machine comprising:

a motor housing accommodating a motor for driving a compressor;

a compressor casing accommodating the compressor;

a fixed scroll disposed in the compressor casing;

an orbiting scroll driven via a driving shaft of the motor and defining a compression chamber as positioned in opposed relation to the fixed scroll; and a plurality of auxiliary crankshafts for preventing the autorotation of the orbiting scroll, wherein the plurality of auxiliary crankshafts are retained by a plurality of first auxiliary crank bearings mounted to the compressor casing and a plurality of second auxiliary crank bearings mounted to the orbiting scroll, respectively, the motor has a stator, and a plurality of notches or hole structures are formed on the motor housing at places between the stator and the first auxiliary crank bearings.

2. The scroll type fluid machine according to claim 1, wherein a number of the notches or the hole structures equals the number of the auxiliary crankshafts.

3. The scroll type fluid machine according to claim 2, wherein the number of the auxiliary crankshafts is three while the number of the notches or the hole structures is also three.

4. The scroll type fluid machine according to claim 1, wherein a part of the notch or the hole structure is on the compressor casing.

5. The scroll type fluid machine according to claim 1, wherein an angle between adjoining notches or hole structures as seen from the driving shaft is less than 180°.

6. A scroll type fluid machine comprising:

a motor housing accommodating a motor for driving a compressor;

a compressor casing accommodating the compressor;

a fixed scroll disposed in the compressor casing;

an orbiting scroll driven via a driving shaft of the motor and defining a compression chamber as positioned in opposed relation to the fixed scroll; and a plurality of auxiliary crankshafts for preventing the autorotation of the orbiting scroll, wherein the plurality of auxiliary crankshafts are retained by a plurality of first auxiliary crank bearings mounted to the compressor casing and a plurality of second auxiliary crank bearings mounted to the orbiting scroll, respectively, a plurality of notches or hole structures are formed on the motor housing or the compressor casing at places between the first auxiliary crank bearings and a stator disposed in the motor.

7. The scroll type fluid machine according to claim 6, wherein a number of the notches or hole structures equals the number of the auxiliary crankshafts.

8. The scroll type fluid machine according to claim 7, wherein the number of the auxiliary crankshafts and the number of the notches or hole structures are three.

9. The scroll type fluid machine according to claim 6, wherein an angle between adjoining notches or hole structures as seen from the driving shaft is less than 180°.

* * * * *